United States Patent [19]

Lub

[11] 4,285,502

[45] Aug. 25, 1981

[54] DEVICE FOR KEEPING CONSTANT THE TENSILE STRESS IN A CABLE

[76] Inventor: Dirk J. C. Lub, Dirk de Derdelaan 309, Vlaardingen, Netherlands

[21] Appl. No.: 911,106

[22] Filed: May 31, 1978

[30] Foreign Application Priority Data

Jun. 1, 1977 [NL] Netherlands ..... 7706008

[51] Int. Cl.[3] ..... B66D 1/36

[52] U.S. Cl. ..... 254/398; 226/199

[58] Field of Search ..... 254/172, 173 R, 190 R, 254/175.7; 226/104, 195, 196, 198, 199; 91/4 A, 390; 60/413, 415; 267/124

[56] References Cited

U.S. PATENT DOCUMENTS

| | | | |
|---|---|---|---|
| 3,343,810 | 9/1967 | Parnell | 254/172 |
| 3,653,635 | 4/1972 | Botes, Jr. | 254/172 |
| 3,661,310 | 5/1972 | Gross | 226/199 |
| 3,949,496 | 4/1976 | Konig et al. | 254/172 |

*Primary Examiner*—Charles A. Marmor
*Assistant Examiner*—Kenneth Noland
*Attorney, Agent, or Firm*—Young & Thompson

[57] ABSTRACT

A device for keeping constant the tensile stress in a cable, comprises two guide pulleys for the cable spaced from each other and disposed in a common plane. A plurality of pulleys are disposed between the two guide pulleys in that same plane and are secured to a piston-cylinder unit that exerts a substantially constant force on those pulleys. The guide pulleys and the cable are movable relative to each other so that these intermediate pulleys can be moved out of engagement with the cable. The guide pulleys are also mounted on a frame that is movable perpendicular to that plane.

6 Claims, 4 Drawing Figures

DEVICE FOR KEEPING CONSTANT THE TENSILE STRESS IN A CABLE

The invention relates to a device for keeping constant the tensile stress in a cable, comprising two guide pulleys for the cable disposed in one plane at a distance from each other, and at least one pulley disposed between the two said guide pulleys and in the same plane, said pulley being secured to a piston-cylinder unit in such a manner that an essentially constant force is exerted upon the pulley owing to the interior of the cylinder communicating with an hydraulic system for the purpose of maintaining an essentially constant pressure within the cylinder, the intermediate pulley in its operative position guiding the cable from the one guide pulley to the other while forming a loop. Such device is known from the U.S. Pat. No. 3,311,351.

In this known device, the guide pulleys and the piston-cylinder unit form a rigidly mounted assembly with the intermediate pulley so that all pulleys of the device are constantly in engagement with the cable.

The known device has the disadvantage that it cannot be disengaged when required, so that a balancing force is constantly exerted upon the cable, it being somewhat laborious to guide the cable over the pulleys when it must be run out. For that reason, the known device is not suitable for being applied e.g. in a tugboat to keep constant the tensile stress in the towing cable.

The object of the invention is to provide a device of the type as mentioned, devoid of the said disadvantage.

By the device according to the invention, this is achieved in that means are provided to displace the guide pulleys and the cable with respect to each other and in that the piston-cylinder unit is constructed in such a manner that the intermediate pulley can be moved out of engagement with the cable.

Preferably, the guide pulleys are mounted on a frame mounted for movement perpendicularly to the plane of the pulleys, the piston-cylinder unit with the intermediate pulley being likewise mounted on said frame.

The guide pulleys may be disposed on either side of the cable, two intermediate pulleys, each connected with a piston-cylinder unit, then being present and situated on either side of the cable in the reverse order of succession.

The guide pulleys may then be adjustable in the direction towards and away from the cable.

Preferably, the hydraulic system comprises an accumulator communicating with the interior of the cylinder, each cylinder then being movably mounted according to the invention and the corresponding intermediate pulley being secured to one side of the cylinder while a cylindrical piston protrudes from the cylinder near the other side and is firmly secured at its free end, the cylinder being connected with a spring means tending to drive the cylinder towards the piston and the interior of the cylinder having two connecting conduits with a reservoir, a pump and a non-return valve being incorporated in one conduit and a stop valve in the other conduit. The spring means may be formed by an hydraulic cylinder communicating with the accumulator.

The invention will now be further explained while referring the drawings.

Figure 1:
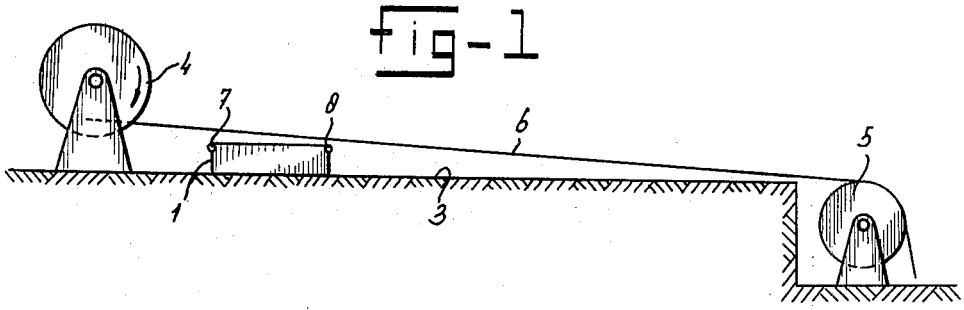
FIG. 1 shows diagrammatically a side view of a device according to the invention in the non-operative position.
Figure 2:
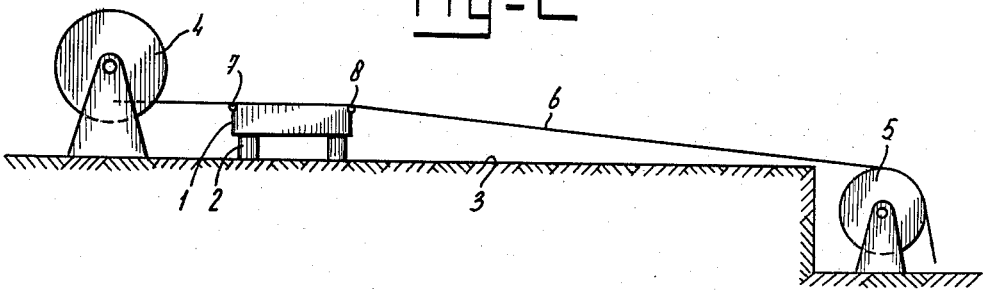
FIG. 2 shows said device in the operative position.
Figure 3:
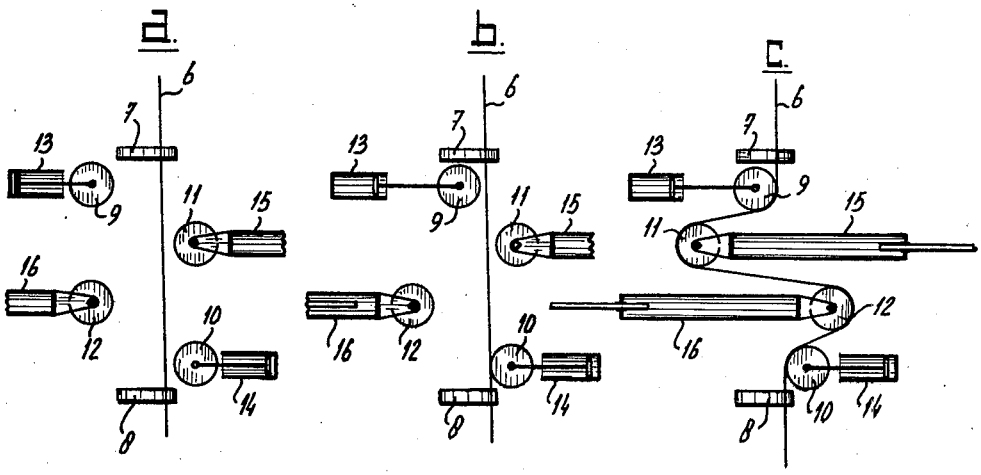
FIG. 3 shows a plan view of the various positions of the pulleys of the device when it is put into operation.

As shown in FIGS. 1, 2 and 3, the device according to the invention is mounted on a frame 1 which can be moved up and down by means of the hydraulic cylinders 2 with respect to, say, the deck 3 of a tug-boat. Also, a winch 4 and an aft roller 5 are mounted on said tug-boat for the purpose of hauling in and guiding a towing cable 6.

On the frame 1, two guide rollers 7 and 8 are mounted and, between said rollers, the guide pulleys 9 and 10 and the intermediate pulleys 11 and 12. The guide pulleys 9 and 10 can be moved towards and away from the cable 6 by means of the hydraulic cylinders 13 and 14. The intermediate pulleys 11 and 12 are connected with the piston-cylinder units 15 and 16 respectively, the cylinders being connected with said pulleys and movably mounted as will be further explained while referring to FIG. 4.

As shown in FIG. 1, the device is out of operation when the frame 1 is retracted so that the cable 6 can be hauled in by means of the winch 4. The frame 1 is then raised until the rollers 7 and 8 engage the cable 6. Thereupon, the guide pulleys 9 and 10 are moved towards the cable 6 as shown in FIG. 3*b*, and finally, the piston-cylinder units 15 and 16 with the intermediate pulleys 11 and 12 secured to them are moved towards the cable 6 until the situation as shown in FIG. 3*c* is obtained, in which the device is in its operative position.

Figure 4:
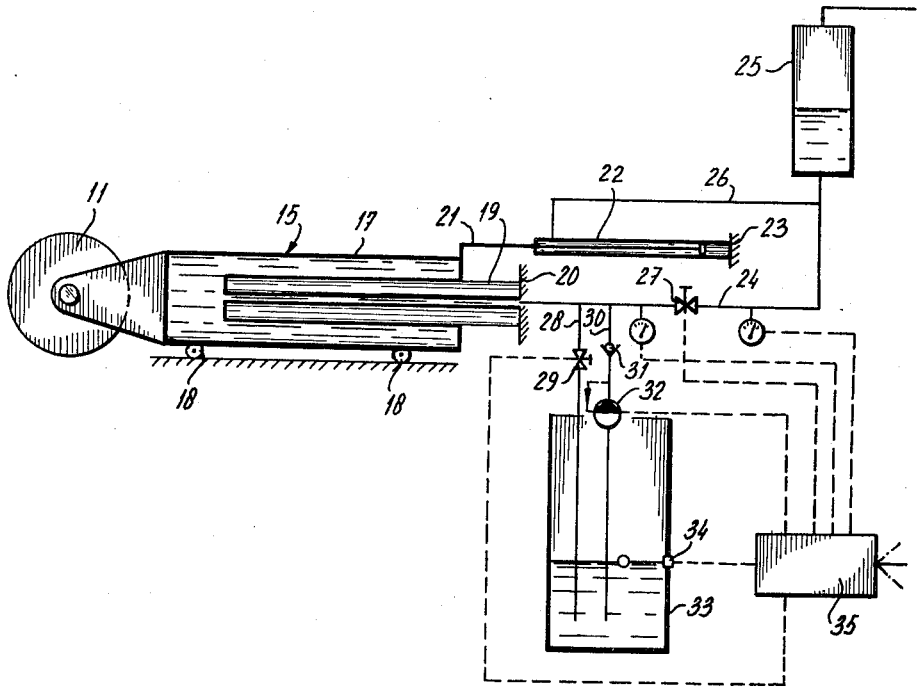
FIG. 4 shows a diagram of the hydraulic system.

As shown in FIG. 4 for the intermediate pulley 11 and the corresponding piston-cylinder unit, the pulley 11 is secured to the cylinder 17 which, as shown diagrammatically by the rollers 18, is reciprocatingly mounted. In the cylinder 17, the piston 19 is situated which is firmly secured at 20 whereas the cylinder 17 is connected with the piston rod 21 of an hydraulic cylinder 22 which is firmly secured at 23. Via the conduit 24, the interior of the cylinder 17 is in communication with the accumulator 25 while the hydraulic cylinder 22 is in communication with the accumulator 25 via the conduit 26. A stop valve 27 is incorporated in the connecting conduit 24. Furthermore, the interior of the cylinder 17 is in communication with the reservoir 33 via the conduit 28 having the valve 29 incorporated therein and via the conduit 30 having the non-return valve 31 and the pump 32 incorporated therein. The reservoir 33 is fitted with a level switch 34.

A logical control by means of which the hydraulic system can be operated is shown at 35. When the logical control 35 is switched on, the stop valve 29 is closed, the pump 32 is put into operation and the stop valve 27 is slowly opened, as a result of which the cylinder 17 will move to the left in the figure until the surface of the liquid in the reservoir 33 will have attained the level determined by the level switch 34. The cylinder 17 with the pulley 11 will then be in its operative position as shown in FIG. 3*c*, while a constant pressure is exerted inside the cylinder 17 by means of the accumulator 25. When the tensile stress in the cable 6 exceeds a predetermined value, the intermediate pulley 11 with the cylinder 17 will again move to the right in FIG. 4 until the tensile stress in the cable will have attained the predetermined value.

In the switched-off position of the logical control 35, the stop valve 27 is slowly closed and the stop valve 29 is opened, as a result of which the cylinder 17 with the pulley 11 secured to it is entirely drawn to the right in FIG. 4 by the hydraulic cylinder 22 until the pulley 11 has become entirely disengaged from the cable 6, as shown in FIG. 3*a*. Therefore, in this manner, it will be possible to entirely retract the pulley 11 or 12 without discharging the accumulator 25.

I claim:

1. Device for keeping constant the tensile stress in a cable or the like, comprising two guide pulleys for the cable disposed in one plane at a distance from each other and at least one pulley disposed between the two said guide pulleys and in the same plane, said at least one pulley being secured to a piston-cylinder unit in such a manner than an essentially constant force is exerted upon the pulley owing to the interior of the cylinder communication with an hydraulic system for the purpose of maintaining an essentially constant hydraulic pressure within the cylinder, the intermediate pulley in the operative position guiding the cable from the one guide pulley to the other while forming a loop, characterized in that means are provided to move the guide pulleys and the cable with respect to each other and that the piston-cylinder unit is constructed in such a manner that the intermediate pulley can be moved out of engagement with the cable, the guide pulleys being mounted on a frame mounted for movement perpendicularly to the plane of the pulleys and the piston-cylinder unit with the intermediate pulley being likewise mounted on said frame.

2. Device according to claim 1, characterized in that the guide pulleys are disposed on either side of the cable and that two intermediate pulleys, each connected with a piston-cylinder unit, are present and are disposed on either side of the cable in the reverse order of succession.

3. Device according to claim 1, characterized in that the guide pulleys are adjustable in the direction towards and from the cable.

4. Device according to claim 1, comprising two guide pulleys for the cable disposed in one plane at a distance from each other and on opposite sides of the cable, two intermediate pulleys disposed between the two guide pulleys and in the same plane as the guide pulleys and on opposite sides of the cable in the reverse order of succession from the guide pulleys, means for moving the pulleys toward the cable until the cable is reeved in a serpentine configuration about the pulleys and for moving the pulleys away from the cable into a position in which the pulleys are completely disengaged from the cable for rapid movement of the cable, and a hydraulic system for maintaining a substantially constant pressure of said intermediate pulleys on said cable when said pulleys are advanced toward each other thereby to maintain substantially constant tension in the cable when the cable is disposed in serpentine configuration about said pulleys.

5. Device according to claim 4, in which the hydraulic system comprises an accumulator communicating with the interior of the cylinder of a cylinder and piston assembly for advancing and retracting each intermediate pulley, characterized in that each cylinder is movably mounted and that the corresponding intermediate pulley is secured to the one side of the cylinder while a cylindrical piston protrudes from the cylinder at its other side and is firmly secured at its free end, that the cylinder is connected with a spring means tending to drive the cylinder towards the piston and that the interior of the cylinder has two connecting conduits with a reservoir, a pump and a non-return valve being incorporated in the one conduit and a stop valve in the other conduit.

6. Device according to claim 5, characterized in that the spring means are formed by a hydraulic cylinder communicating with the accumulator.

* * * * *